US010773255B2

(12) United States Patent
Schmolke

(10) Patent No.: US 10,773,255 B2
(45) Date of Patent: Sep. 15, 2020

(54) CARTRIDGE AND METHOD FOR TESTING A SAMPLE

(71) Applicant: BOEHRINGER INGELHEIM VETMEDICA GMBH, Ingelheim am Rhein (DE)

(72) Inventor: Hannah Schmolke, Didderse (DE)

(73) Assignee: BOEHRINGER INGELHEIM VETMEDICA GMBH, Ingelheim am Rhein (DE)

( * ) Notice: Subject to any disclaimer, the term of this patent is extended or adjusted under 35 U.S.C. 154(b) by 0 days.

(21) Appl. No.: 16/336,967

(22) PCT Filed: Oct. 5, 2017

(86) PCT No.: PCT/EP2017/025286
§ 371 (c)(1),
(2) Date: Mar. 27, 2019

(87) PCT Pub. No.: WO2018/065109
PCT Pub. Date: Apr. 12, 2018

(65) Prior Publication Data

US 2019/0217288 A1 Jul. 18, 2019

(30) Foreign Application Priority Data

Oct. 7, 2016 (EP) ..... 16020378

(51) Int. Cl.

| | |
|---|---|
| ***B01L 3/00*** | (2006.01) |
| ***B65D 81/20*** | (2006.01) |
| ***B65D 77/20*** | (2006.01) |
| ***B65D 81/26*** | (2006.01) |

(52) U.S. Cl.
CPC ..... *B01L 3/502* (2013.01); *B01L 3/5027* (2013.01); *B65D 77/2028* (2013.01); *B65D 77/2032* (2013.01); *B65D 81/20* (2013.01); *B65D 81/2069* (2013.01); *B65D 81/264* (2013.01); *B65D 81/266* (2013.01); *B01L 2200/18* (2013.01); *B01L 2300/021* (2013.01); *B01L 2300/041* (2013.01); *B65D 2203/06* (2013.01)

(58) Field of Classification Search
CPC .... B01L 3/502; B01L 3/5027; B01L 2200/18; B01L 2300/021; B01L 2300/041; B65D 81/20; B65D 77/2032; B65D 81/266; B65D 77/2028; B65D 81/2069; B65D 81/264; B65D 2203/06
See application file for complete search history.

(56) References Cited

U.S. PATENT DOCUMENTS

| | | | |
|---|---|---|---|
| 3,976,195 | A | 8/1976 | Cohen |
| 5,096,669 | A | 3/1992 | Lauks et al. |
| 6,247,598 | B1 | 6/2001 | Hosaka et al. |
| 9,110,044 | B2 | 8/2015 | Gumbrecht et al. |

(Continued)

FOREIGN PATENT DOCUMENTS

DE 102006019422 A1 10/2007

*Primary Examiner* — Dennis White
(74) *Attorney, Agent, or Firm* — David S. Safran; Roberts Calderon Safran & Cole, P.C.

(57) ABSTRACT

A cartridge and a method for testing a biological sample are provided, wherein the cartridge is filled, in an open packaging, with the sample to be tested, and wherein the packaging holds and/or supports the cartridge in a latching manner in an open state.

23 Claims, 6 Drawing Sheets

(56) References Cited

U.S. PATENT DOCUMENTS

| | | | | |
|---|---|---|---|---|
| 2001/0032799 | A1 | 10/2001 | Shinada | |
| 2003/0183637 | A1 | 10/2003 | Zappa et al. | |
| 2011/0150705 | A1 | 6/2011 | Doyle et al. | |
| 2012/0045826 | A1* | 2/2012 | Yantz | A61B 5/15186 435/288.7 |
| 2014/0027326 | A1 | 1/2014 | Peruzzo | |
| 2014/0220702 | A1* | 8/2014 | Johnson | B01L 3/502715 436/180 |
| 2018/0016081 | A1 | 1/2018 | Schneider | |

* cited by examiner

CARTRIDGE AND METHOD FOR TESTING A SAMPLE

BACKGROUND OF THE INVENTION

Field of the Invention

The present invention relates to a cartridge for testing a sample, including a receiving cavity with a connection for receiving the sample, a closure element for fluidically closing the connection, and a packaging enclosing the cartridge in a delivery state, and to a method for testing a sample by means of a cartridge, including receiving the sample in a receiving cavity of the cartridge, and closing a connection of the receiving cavity using a closure element after the cartridge has been filled with the sample, wherein the cartridge is filled with the sample in an open packaging and is removed from the packaging only after the cartridge has been filled with the sample.

Preferably, the present invention deals with analysing and testing a sample, in particular from a human or animal, particularly preferably for analytics and diagnostics, for example with regard to the presence of diseases and/or pathogens and/or for determining blood counts, antibodies, hormones, steroids or the like. Therefore, the present invention is in particular within the field of bioanalytics. A food sample, environmental sample or another sample may optionally also be tested, in particular for environmental analytics or food safety and/or for detecting other substances.

Preferably, by means of the cartridge, at least one analyte (target analyte) of a sample can be determined, identified or detected. In particular, the sample can be tested for qualitatively or quantitatively determining at least one analyte, for example in order for it to be possible to detect or identify a disease and/or pathogen.

Within the meaning of the present invention, analytes are in particular nucleic-acid sequences, in particular DNA sequences and/or RNA sequences, or proteins, in particular antigens and/or antibodies. In particular, by means of the present invention, nucleic-acid sequences can be determined, identified or detected as analytes of a sample, or proteins can be determined, identified or detected as analytes of the sample. More particularly preferably, the present invention deals with systems, devices and other apparatuses for carrying out a nucleic-acid assay for detecting or identifying a nucleic-acid sequence or a protein assay for detecting or identifying a protein.

The present invention deals in particular with what are known as point-of-care systems, i.e. in particular with mobile systems, devices and other apparatuses, and deals with methods for carrying out tests on a sample at the sampling site and/or independently and/or away from a central laboratory or the like. Preferably, point-of-care systems can be operated autonomously and/or independently of a mains network for supplying electrical power.

Description of the Related Art

U.S. Pat. No. 5,096,669 discloses a point-of-care system for testing a biological sample, in particular a blood sample. The system comprises a single-use cartridge and an analysis device. Once the sample has been received, the cartridge is inserted into the analysis device in order to carry out the test. The cartridge comprises a microfluidic system and a sensor apparatus comprising electrodes, which apparatus is calibrated by means of a calibration liquid and is then used to test the sample.

Furthermore, International Publication No. WO 2006/125767 A1 and corresponding U.S. Pat. No. 9,110,044 B2 disclose a point-of-care system for integrated and automated DNA or protein analysis, comprising a single-use cartridge and an analysis device for fully automatically processing and evaluating molecular-diagnostic analyses using the single-use cartridge. The cartridge is designed to receive a sample, in particular blood, and in particular allows cell disruption, PCR and detection of PCR amplification products, which are bonded to capture molecules and provided with a label enzyme, in order for it to be possible to detect bonded PCR amplification products or nucleic-acid sequences as target analytes in what is known as a redox cycling process.

US Patent Application Publication No. 2011/0150705 A1 discloses a cartridge with two hinged parts that are folded together to form the cartridge. The cartridge may be packaged in a moisture resilient container forming a primary package which may be fed into a secondary packaging unit for boxing and overpacking.

Usually, a sample to be tested is received in the cartridge before the cartridge is inserted into an analysis device. The handling of the sample is not uncritical.

SUMMARY OF THE INVENTION

The problem addressed by the present invention is to provide a cartridge and a method for testing a sample, preferably by means of which simple and secure handing and/or testing is/are made possible or facilitated.

The above problem is solved by a cartridge for testing a sample, the cartridge including a receiving cavity with the connection for receiving the sample, a closure element for fluidically closing the connection, and a packaging closing the cartridge in a delivery state, wherein the packaging includes a support apparatus for supporting the cartridge, and/or a mounting apparatus for mounting the cartridge in at least one of a form-fit, interlocking, clamping and latching manner, and/or a lower part comprising a peripheral edge for receiving and mounting the cartridge, and a removable lid for closing the lower part, such that, when the packaging is open, the cartridge can be filled in the packaging and the connection can be closed in the packaging. The above problem is also solved by a method for testing a sample by means of a cartridge, the method including the steps of receiving the sample in a receiving cavity of the cartridge and closing a connection of the receiving cavity using a closure element after the cartridge has been filled with the sample, wherein the cartridge is filled with the sample in an open packaging and is removed from the packaging only subsequent to the cartridge being filled with the sample.

It is proposed that the cartridge is delivered in a packaging, i.e. comprises a packaging in the delivery state. It is proposed that the cartridge and the packaging are designed such that, after the packaging has been opened, the cartridge can be filled in the packaging with a sample to be tested.

In particular, a receiving cavity of the cartridge is filled with the sample via a connection. Following the filling process, the connection is closed. This in particular also takes place in the packaging. In principle, however, the connection can also be closed by means of a closure element only after the cartridge has been removed from the packaging.

The proposed method allows very simple and reliable handling. In particular, simple filling of the cartridge with the sample to be tested is made possible or facilitated. Furthermore, the risk of undesired contamination can thus be reduced.

After the cartridge can been filled with the sample, the sample is preferably tested in the cartridge. Particularly preferably, the cartridge is connected to and/or received by a corresponding analysis device for this purpose.

According to one aspect of the present invention, the packaging preferably comprises a mounting apparatus for mounting the cartridge in the packaging, in particular in a form-fit, interlocking, clamped and/or latching manner. This facilitates filling and in particular also closing of the cartridge in the packaging when the packaging is open.

According to another aspect of the present invention, the packaging preferably comprises a support apparatus for supporting the cartridge in the packaging. This facilitates filling and in particular also closing of the cartridge in the packaging when the packaging is open.

According to another aspect of the present invention, the packaging comprises a lower part and a peripheral edge for receiving and in particular laterally mounting the cartridge, and a removable or pull-off lid for closing the lower part. This facilitates filling and in particular also closing of the cartridge in the packaging when the packaging is open.

Particularly preferably, the connection is arranged on a flat side and/or upper face of the cartridge, and the cartridge is received with its opposite flat side and/or its lower face in the lower part of the packaging. This allows particularly simple and/or intuitive handling.

The term "cartridge" is preferably understood to mean a structural apparatus or unit designed to receive, to store, to physically, chemically and/or biologically treat and/or prepare and/or to measure a sample, preferably in order to make it possible to detect, identify or determine at least one analyte, in particular a protein and/or a nucleic-acid sequence, of the sample.

A cartridge within the meaning of the present invention preferably comprises a fluid system having a plurality of channels, cavities and/or valves for controlling the flow through the channels and/or cavities.

In particular, within the meaning of the present invention, a cartridge is designed to be at least substantially planar, flat and/or card-like, in particular is designed as a (micro)fluidic card and/or is designed as a main body or container that can preferably be closed and/or said cartridge can be inserted and/or plugged into a proposed analysis device when it contains the sample.

The above-mentioned aspects and features of the present invention and the aspects and features of the present invention that will become apparent from the claims and the following description can in principle be implemented independently from one another, but also in any combination or order.

Other aspects, advantages, features and properties of the present invention will become apparent from the claims and the following description of a preferred embodiment with reference to the accompanying drawings.

DETAILED DESCRIPTION OF THE INVENTION

In the Figures, which are only schematic and sometimes not to scale, the same reference signs are used for the same or similar parts and components, corresponding or comparable properties and advantages being achieved even if these are not repeatedly described.

Figure 1:
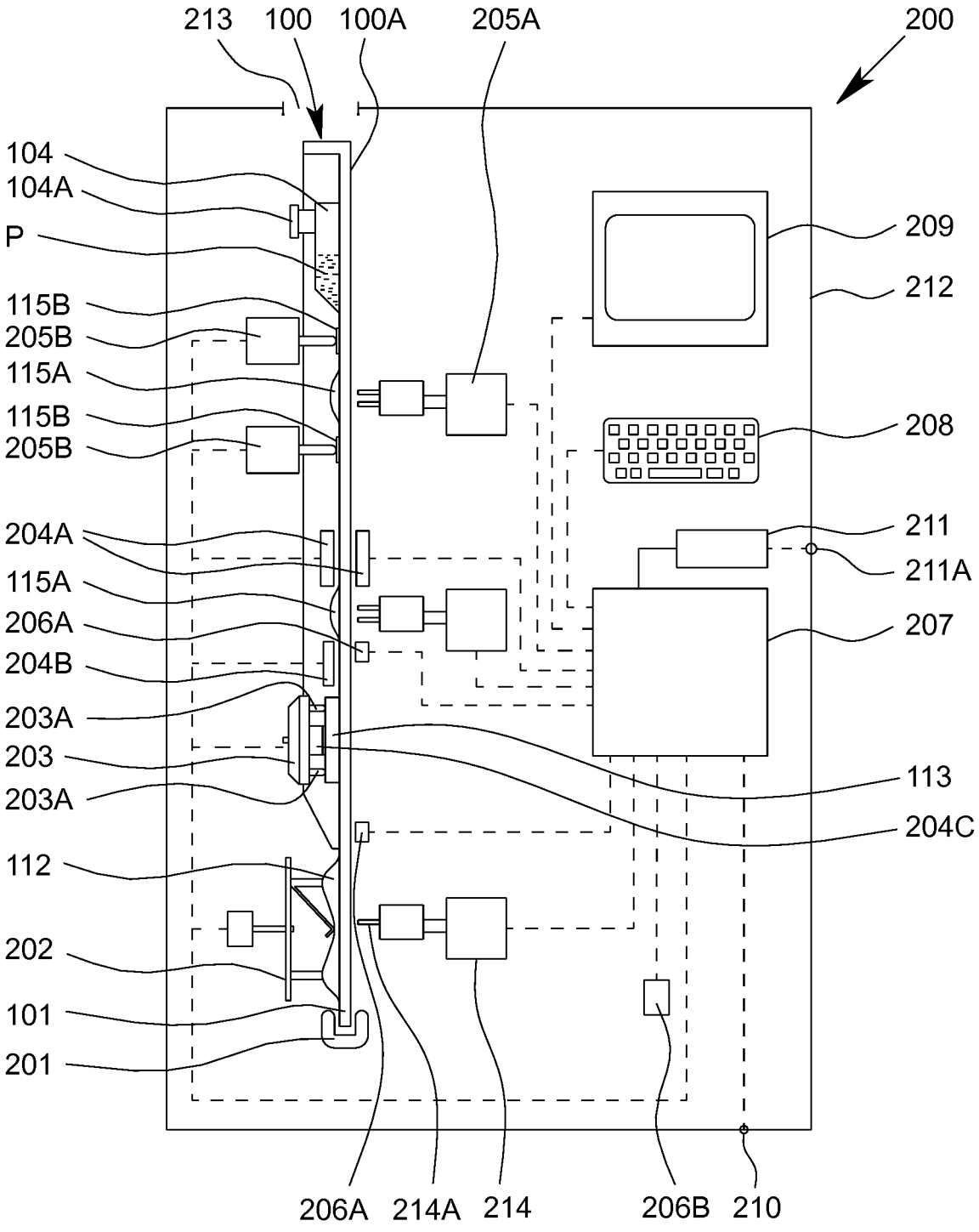
FIG. 1 is a schematic view of a proposed analysis device and a proposed cartridge received in the analysis device.

FIG. 1 is a highly schematic view of a proposed apparatus or cartridge 100 in an analysis device 200 for testing an in particular biological sample P.

Figure 2:
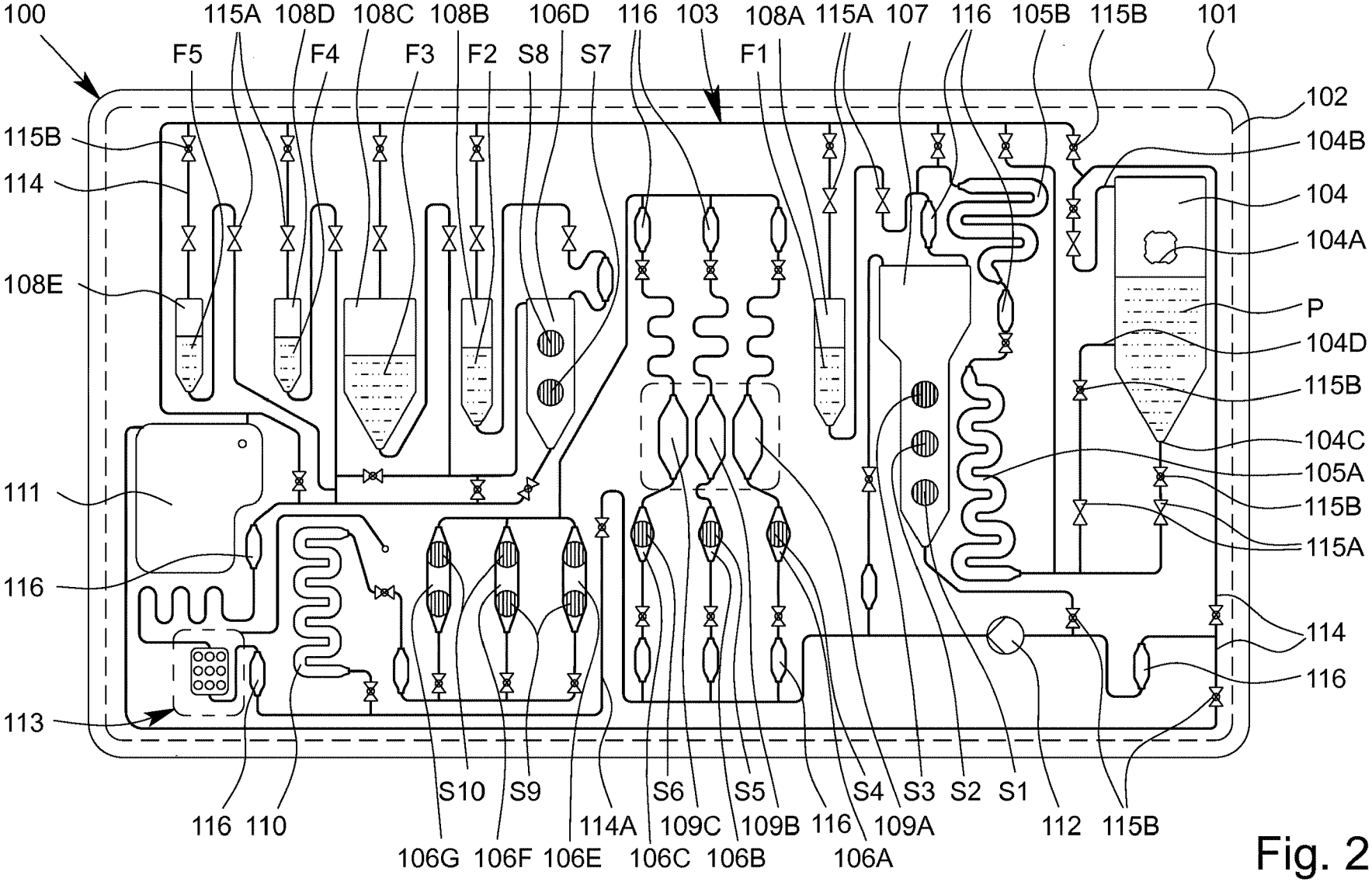
FIG. 2 is a schematic view of the cartridge.

FIG. 2 is a schematic view of a preferred embodiment of the proposed apparatus or cartridge 100 for testing the sample P. The apparatus or cartridge 100 in particular forms a handheld unit, and in the following is merely referred to as a cartridge 100.

The term "sample" is preferably understood to mean the sample material to be tested, which is in particular taken from a human or animal. In particular, within the meaning of the present invention, a sample is a fluid, such as saliva, blood, urine or another liquid, preferably from a human or animal, or a component thereof. Within the meaning of the present invention, a sample may be pretreated or prepared if necessary, or may come directly from a human or animal or the like, for example. A food sample, environmental sample or another sample may optionally also be tested, in particular for environmental analytics, food safety and/or for detecting other substances, preferably natural substances, but also biological or chemical warfare agents, poisons or the like.

A sample within the meaning of the present invention preferably contains one or more analytes, it preferably being possible for the analytes to be identified or detected, in particular qualitatively and/or quantitatively determined. Particularly preferably, within the meaning of the present invention, a sample has target nucleic-acid sequences as the analytes, in particular target DNA sequences and/or target RNA sequences, and/or target proteins as the analytes, in particular target antigens and/or target antibodies. Particularly preferably, at least one disease and/or pathogen can be detected or identified in the sample P by qualitatively and/or quantitatively determining the analytes.

Preferably, the analysis device 200 controls the testing of the sample P in particular in or on the cartridge 100 and/or is used to evaluate the testing and/or to collect to process and/or to store measured values from the test.

By means of the analysis device 200 and/or by means of the cartridge 100 and/or using the method for testing the sample P, an analyte of the sample P, or particularly preferably a plurality of analytes of the sample P, can be preferably determined, identified or detected. Said analytes are in particular detected and/or measured not only qualitatively, but particularly preferably also quantitatively.

Therefore, the sample P can in particular be tested for qualitatively or quantitatively determining at least one analyte, for example in order for it to be possible to detect or identify a disease and/or pathogen or to determine other values, which are important for diagnostics, for example.

The cartridge 100 is preferably at least substantially planar, flat, plate-shaped and/or card-like.

The cartridge 100 preferably comprises an in particular at least substantially planar, flat, plate-shaped and/or card-like main body or support 101, the main body or support 101 in particular being made of and/or injection-moulded from plastics material, particularly preferably polypropylene.

The cartridge 100 preferably comprises at least one film or cover 102 for covering the main body 101 and/or cavities and/or channels formed therein at least in part, in particular on the front, and/or for forming valves or the like, as shown by dashed lines in FIG. 2.

The analysis system 1, cartridge 100 and/or the main body 101 thereof, in particular together with the cover 102, preferably forms and/or comprises a fluidic system 103, referred to in the following as the fluid system 103.

The cartridge 100, the main body 101 and/or the fluid system 103 are preferably at least substantially vertically oriented in the operating position and/or during the test, in particular in the analysis device 200, as shown schematically in FIG. 1. In particular, the main plane or surface extension of the cartridge 100 thus extends at least substantially vertically in the operating position.

The cartridge 100 and/or the fluid system 103 preferably comprises a plurality of cavities, in particular at least one receiving cavity 104, at least one metering cavity 105, at least one intermediate cavity 106, at least one mixing cavity 107, at least one storage cavity 108, at least one reaction cavity 109, at least one intermediate temperature-control cavity 110 and/or at least one collection cavity 111, the cavities preferably being fluidically interconnected by a plurality of channels.

Within the meaning of the present invention, channels are preferably elongate forms for conducting a fluid in a main flow direction, the forms preferably being closed transversely, in particular perpendicularly, to the main flow direction and/or longitudinal extension, preferably on all sides.

In particular, the main body 101 comprises elongate notches, recesses, depressions or the like, which are closed at the sides by the cover 102 and form channels within the meaning of the present invention.

Within the meaning of the present invention, cavities or chambers are preferably formed by recesses, depressions or the like in the cartridge 100 or main body 101, which are closed or covered by the cover 102, in particular at the sides. The volume or space enclosed by each cavity is preferably fluidically linked, in particular to the fluid system 103, by means of channels.

In particular, within the meaning of the present invention, a cavity comprises at least two openings for the inflow and/or outflow of fluids.

Within the meaning of the present invention, cavities preferably have a larger diameter and/or flow cross section than channels, preferably by at least a factor of 2, 3 or 4. In principle, however, cavities may in some cases also be elongate, in a similar manner to channels.

The cartridge 100 and/or the fluid system 103 also preferably comprises at least one pump apparatus 112 and/or at least one sensor arrangement or sensor apparatus 113.

In the example shown, the cartridge 100 or the fluid system 103 preferably comprises two metering cavities 105A and 105B, a plurality of intermediate cavities 106A to 106G, a plurality of storage cavities 108A to 108E and/or a plurality of reaction cavities 109, which can preferably be loaded separately from one another, in particular a first reaction cavity 109A, a second reaction cavity 109B and an optional third reaction cavity 109C, as can be seen in FIG. 2.

The metering cavities 105 are preferably designed to receive, to temporarily store and/or to meter the sample, and/or to pass on said sample in a metered manner Particularly preferably, the metering cavities 105 have a diameter which is larger than that of the (adjacent) channels.

In the initial state of the cartridge or when at the factory, the storage cavities 108 are preferably filled at least in part, in particular with a liquid such as a reagent, solvent or wash buffer.

The collection cavity 111 is preferably designed to receive larger quantities of fluids that are in particular used for the test, such as sample residues or the like. Preferably, in the initial state or when at the factory, the collection cavity 111 is empty or filled with gas, in particular air. The volume of the collection cavity 111 corresponds to or exceeds preferably the (cumulative) volume of the storage cavity/cavities 108 or the liquid content thereof and/or the volume of the receiving cavity 104 or the sample P received.

The reaction cavity/cavities 109 is/are preferably designed to allow a substance located in the reaction cavity 109 to react when an assay is being carried out, for example by being linked or coupled to apparatuses or modules of the analysis device 200.

The reaction cavity/cavities 109 is/are used in particular to carry out an amplification reaction, in particular PCR, or several, preferably different, amplification reactions, in particular PCRs. It is preferable to carry out several, preferably different, PCRs, i.e. PCRs having different primer combinations or primer pairs, in parallel and/or independently and/or in different reaction cavities 109.

"PCR" stands for polymerase chain reaction and is a molecular-biological method by means of which certain analytes, in particular portions of RNA or RNA sequences or DNA or DNA sequences, of a sample P are amplified, preferably in several cycles, using polymerases or enzymes, in particular in order to then test and/or detect the amplification products or nucleic-acid products. If RNA is intended to be tested and/or amplified, before the PCR is carried out, a cDNA is produced starting from the RNA, in particular using reverse transcriptase. The cDNA is used as a template for the subsequent PCR.

The amplification products, target nucleic-acid sequences and/or other portions of the sample P produced in the one or more reaction cavities 109 can be conducted or fed to the connected sensor arrangement or sensor apparatus 113, in particular by means of the pump apparatus 112.

The sensor arrangement or sensor apparatus 113 is used in particular for detecting, particularly preferably qualitatively and/or quantitatively determining, the analyte or analytes of the sample P, in this case particularly preferably the target nucleic-acid sequences and/or target proteins as the analytes. Alternatively or additionally, however, other values may also be collected or determined.

The cartridge 100, the main body 101 and/or the fluid system 103 preferably comprise a plurality of channels 114 and/or valves 115, as shown in FIG. 2.

By means of the channels 114 and/or valves 115, the cavities 104 to 111, the pump apparatus 112 and/or the sensor arrangement or sensor apparatus 113 can be temporarily and/or permanently fluidically interconnected and/or fluidically separated from one another, as required and/or optionally or selectively, in particular such that they are controlled by the analysis device 200.

The cavities 104 to 111 are preferably each fluidically linked or interconnected by a plurality of channels 114. Particularly preferably, each cavity is linked or connected by at least two associated channels 114, in order to make it possible for fluid to fill, flow through and/or drain from the respective cavities as required.

The fluid transport or the fluid system 103 is preferably not based on capillary forces, or is not exclusively based on said forces, but in particular is essentially based on the effects of gravity and/or pumping forces and/or compressive forces and/or suction forces that arise, which are particularly preferably generated by the pump or pump apparatus 112. In this case, the flows of fluid or the fluid transport and the metering are controlled by accordingly opening and closing the valves 115 and/or by accordingly operating the pump or pump apparatus 112, in particular by means of a pump drive 202 of the analysis device 200.

Preferably, each of the cavities 104 to 110 has an inlet at the top and an outlet at the bottom in the operating position. Therefore, if required, only liquid from the respective cavities can be removed via the outlet.

In the operating position, the liquids from the respective cavities are preferably removed, in particular drawn out, via the outlet that is at the bottom in each case, it preferably being possible for gas or air to flow and/or be pumped into the respective cavities via the inlet that is in particular at the top. In particular, relevant vacuums in the cavities can thus be prevented or at least minimised when conveying the liquids.

In particular, the cavities, particularly preferably the storage cavity/cavities 108, the mixing cavity 107 and/or the receiving cavity 104, are each dimensioned and/or oriented in the normal operating position such that, when said cavities are filled with liquid, bubbles of gas or air that may potentially form rise upwards in the operating position, such that the liquid collects above the outlet without bubbles. However, other solutions are also possible here.

The receiving cavity 104 preferably comprises a connection 104A for introducing the sample P. In particular, the sample P may for example be introduced into the receiving cavity 104 and/or cartridge 100 via the connection 104A by means of a pipette, syringe or other instrument.

The receiving cavity 104 preferably comprises an inlet 104B, an outlet 104C and an optional intermediate connection 104D, it preferably being possible for the sample P or a portion thereof to be removed and/or conveyed further via the outlet 104C and/or the optional intermediate connection 104D. Gas, air or another fluid can flow in and/or be pumped in via the inlet 104B, as already explained.

Preferably, the sample P or a portion thereof can be removed, optionally and/or depending on the assay to be carried out, via the outlet 104C or the optional intermediate connection 104D of the receiving cavity 104. In particular, a supernatant of the sample P, such as blood plasma or blood serum, can be conducted away or removed via the optional intermediate connection 104D, in particular for carrying out the protein assay.

Preferably, at least one valve 115 is assigned to each cavity, the pump apparatus 112 and/or the sensor apparatus 113 and/or is arranged upstream of the respective inlets and/or downstream of the respective outlets.

Preferably, the cavities 104 to 111 or sequences of cavities 104 to 111, through which fluid flows in series or in succession for example, can be selectively released and/or fluid can selectively flow therethrough by the assigned valves 115 being actuated, and/or said cavities can be fluidically connected to the fluid system 103 and/or to other cavities.

In particular, the valves 115 are formed by the main body 101 and the film or cover 102 and/or are formed therewith and/or are formed in another manner, for example by or having additional layers, depressions or the like.

Particularly preferably, one or more valves 115A are provided which are preferably tightly closed initially or when in storage, particularly preferably in order to seal liquids or liquid reagents F, located in the storage cavities 108, and/or the fluid system 103 from the open receiving cavity 104 in a storage-stable manner.

Preferably, an initially closed valve 115A is arranged upstream and downstream of each storage cavity 108. Said valves are preferably only opened, in particular automatically, when the cartridge 100 is actually being used and/or during or after inserting the cartridge 100 into the analysis device 200 and/or for carrying out the assay.

A plurality of valves 115A, in particular three valves in this case, are preferably assigned to the receiving cavity 104, in particular if the intermediate connection 104D is provided in addition to the inlet 104B and the outlet 104C. Depending on the use, in addition to the valve 115A on the inlet 104B, then preferably only the valve 115A either at the outlet 104C or at the intermediate connection 104D is opened.

The valves 115A assigned to the receiving cavity 104 seal the fluid system 103 and/or the cartridge 100 in particular fluidically and/or in a gas-tight manner, preferably until the sample P is inserted and/or the receiving cavity 104 or the connection 104A of the receiving cavity 104 is closed.

As an alternative or in addition to the valves 115A (which are initially closed), one or more valves 115B are preferably provided which are not closed in a storage-stable manner and/or which are open initially or in an inoperative position, in an initial state or when the cartridge 100 is not inserted into the analysis device 200, and/or which can be closed by actuation. These valves 115B are used in particular to control the flows of fluid during the test.

The cartridge 100 is preferably designed as a microfluidic card and/or the fluid system 103 is preferably designed as a microfluidic system. In the present invention, the term "microfluidic" is preferably understood to mean that the respective volumes of individual cavities, some of the cavities or all of the cavities 104 to 111 and/or channels 114 are, separately or cumulatively, less than 5 ml or 2 ml, particularly preferably less than 1 ml or 800 μl in particular less than 600 μl or 300 μl more particularly preferably less than 200 μl or 100 μl.

Particularly preferably, a sample P having a maximum volume of 5 ml, 2 ml or 1 ml can be introduced into the cartridge 100 and/or the fluid system 103, in particular the receiving cavity 104.

Reagents and liquids which are preferably introduced or provided before the test in liquid form as liquids or liquid reagents F and/or in dry form as dry reagents S are required for testing the sample P, as shown in the schematic view according to FIG. 2 by reference signs F1 to F5 and S1 to S10.

Furthermore, other liquids F, in particular in the form of a wash buffer, solvent for dry reagents S and/or a substrate, for example in order to form detection molecules D and/or a redox system, are also preferably required for the test, the detection process and/or for other purposes, and are in particular provided in the cartridge 100, i.e. are likewise introduced before use, in particular before delivery. At some points in the following, a distinction is not made between liquid reagents and other liquids, and therefore the respective explanations are accordingly also mutually applicable.

The cartridge 100 preferably contains all the reagents and liquids required for pretreating the sample P and/or for carrying out the test or assay, in particular for carrying out one or more amplification reactions or PCRs, and therefore, particularly preferably, it is only necessary to receive the optionally pretreated sample P.

The cartridge 100 or the fluid system 103 preferably comprises a bypass 114A that can optionally be used, in order for it to be possible, if necessary, to conduct or convey the sample P or components thereof past the reaction cavities 109 and/or, by bypassing the optional intermediate temperature-control cavity 110, also directly to the sensor apparatus 113.

The cartridge 100, the fluid system 103 and/or the channels 114 preferably comprise sensor portions 116 or other apparatuses for detecting liquid fronts and/or flows of fluid.

It is noted that various components, such as the channels 114, the valves 115, in particular the valves 115A that are initially closed and the valves 115B that are initially open, and the sensor portions 116 in FIG. 2 are, for reasons of clarity, only labelled in some cases, but the same symbols are used in FIG. 2 for each of these components.

The collection cavity 111 is preferably used for receiving excess or used reagents and liquids and volumes of the sample, and/or for providing gas or air in order to empty individual cavities and/or channels. In the initial state, the collection cavity 111 is preferably filled solely with gas, in particular air.

In particular, the collection cavity 111 can optionally be connected to individual cavities and channels 114 or other apparatuses fluidically in order to remove reagents and liquids from said cavities, channels or other apparatuses and/or to replace said reagents and liquids with gas or air. The collection cavity 111 is preferably given appropriate large dimensions.

Figure 3:
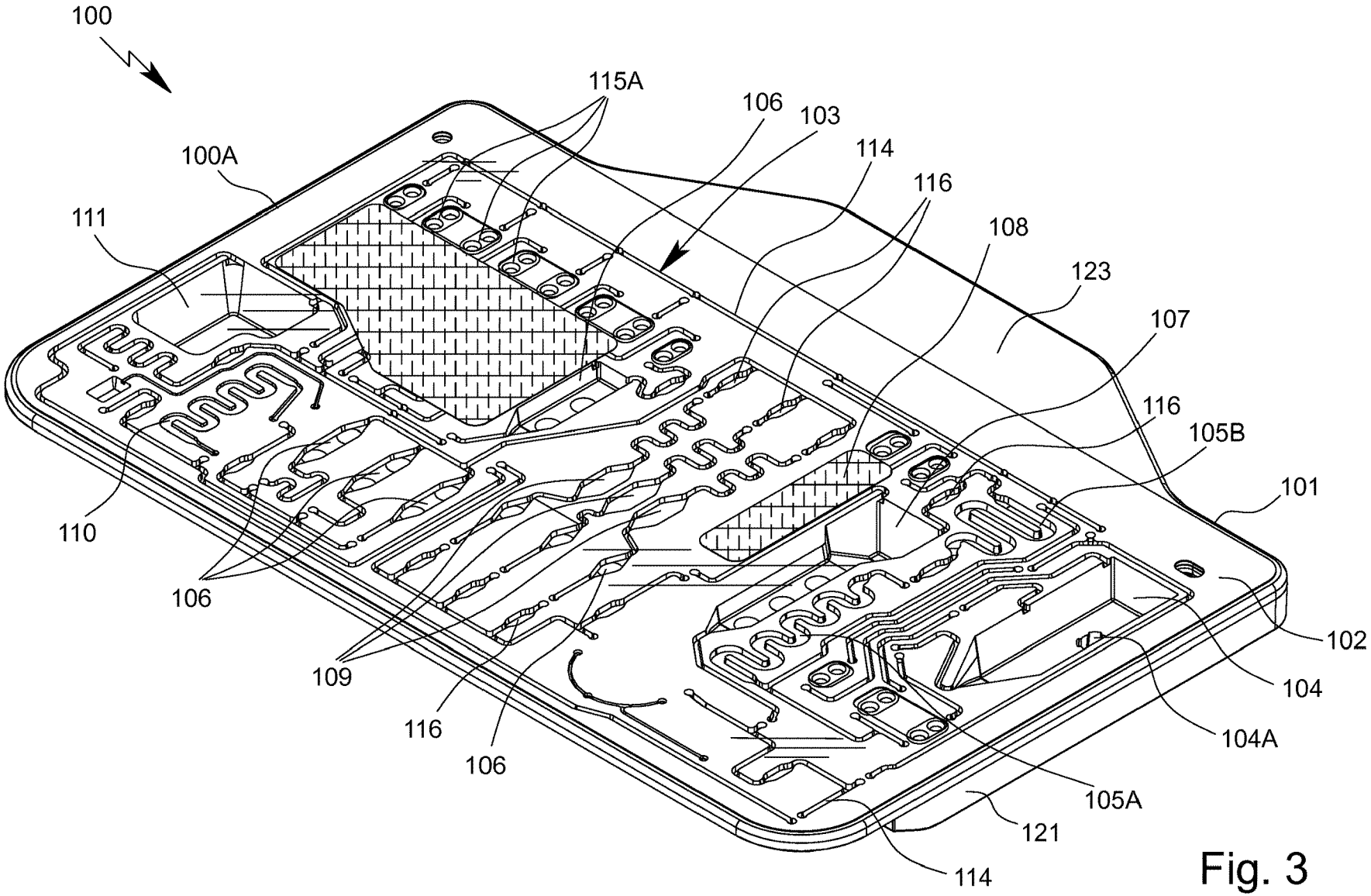
FIG. 3 is a schematic perspective front view of the cartridge.
Figure 4:
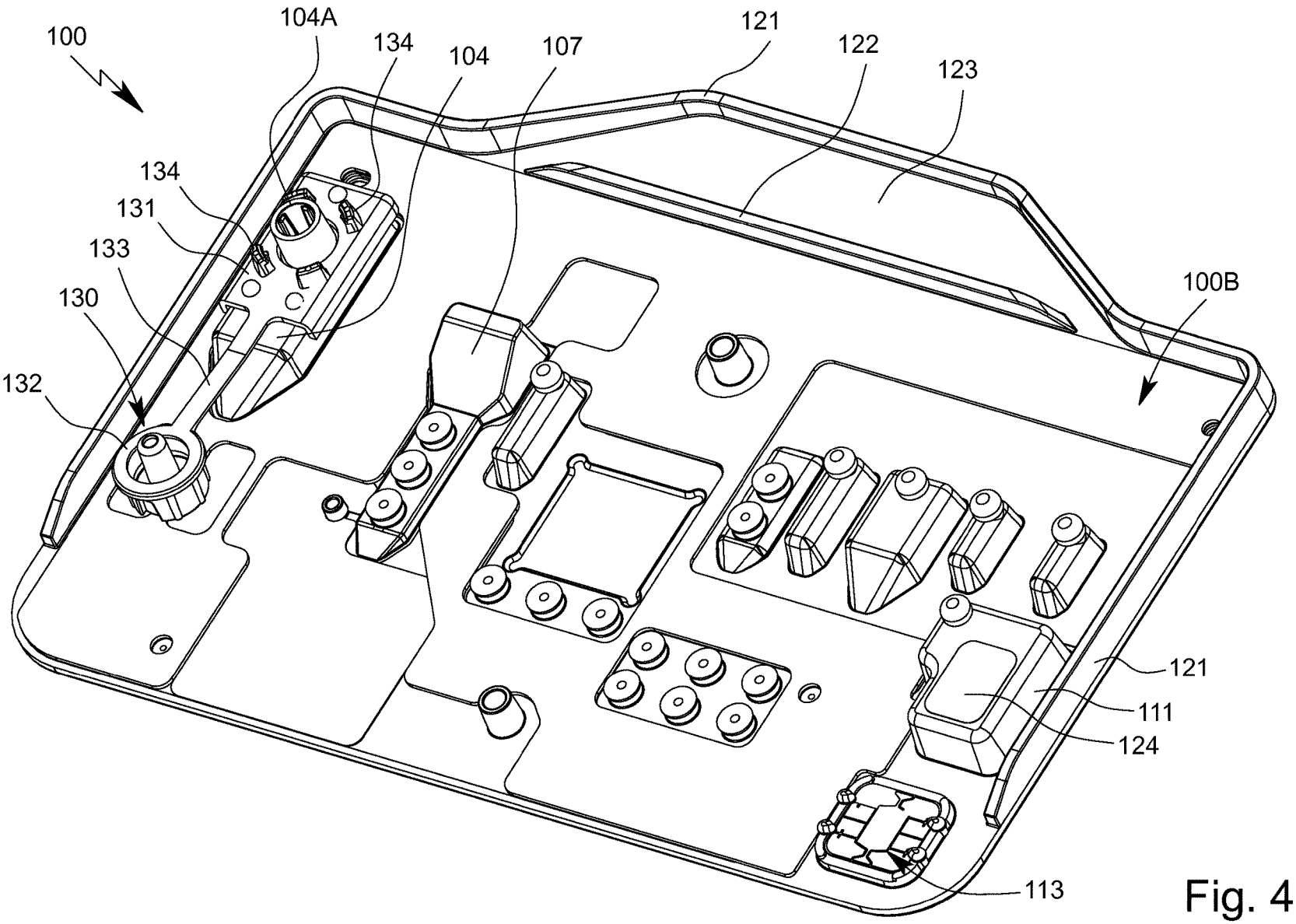
FIG. 4 is a schematic perspective rear view of the cartridge comprising a receiving cavity.

FIG. 3 is a perspective front view of the cartridge 100 and FIG. 4 is a perspective rear view thereof, i.e. of the back 100B thereof.

The cartridge 100 and/or the main body 101 preferably comprises a reinforced or angled edge 121 and/or a reinforcing rib 122, particularly preferably on the back 100B, as shown schematically in FIG. 4.

The cartridge 100 and/or the main body 101 preferably comprises a grip portion 123 in order for it to be possible to optimally grip and/or hold the cartridge 100 by hand. The grip portion 123 is in particular arranged and/or formed or integrally moulded on a longitudinal side.

Particularly preferably, the grip portion 123 extends in the main plane or plate plane of the cartridge 100 or main body 101. In the example shown, the grip portion 123 is particularly preferably substantially trapezoidal. However, other shapes are also possible.

The edge 121 and/or the reinforcing rib 122 preferably projects/project transversely from the main plane or plate plane and/or the back 100B of the cartridge 100 or main body 101.

In the example shown, the edge 121 preferably extends along the two narrow sides and/or along a longitudinal side and/or the grip portion 123 of the cartridge 100 or main body 101, substantially on the outside.

The reinforcing rib 122 preferably extends between the grip portion 123 and the remaining, particularly preferably substantially rectangular, part of the cartridge 100 or main body 101.

The reinforcing rib 122 thus extends at least substantially along a longitudinal side of the preferably at least substantially rectangular basic shape of the cartridge 100.

The edge 121, the reinforcing rib 122 and/or the grip portion 123 is/are preferably formed in one piece with the main body 101, in particular integrally moulded thereon.

The cartridge 100 preferably comprises an in particular optically readable identifier, such as a barcode 124, in this case in particular on the back 100B and/or on the collection cavity 111 and/or adhesively bonded.

The connection 104A of the receiving cavity 104 can be closed after the sample P has been received. The cartridge 100 preferably comprises a closure element 130 for this purpose.

In particular, the connection 104A can be closed in a liquid-tight and particularly preferably also gas-tight manner by the closure element 130. In particular, a closed fluid circuit can thus be formed, with the receiving cavity 104 being included. In particular, once the assigned valves 115A at the inlet 104B, outlet 104C and/or intermediate connection 104D have been opened, the receiving cavity 104 thus forms part of the fluid system 103 of the cartridge 100, wherein the fluid system is preferably closed or can be closed by the closure element 130.

The closure element 130 or the closure part 132 thereof closes the receiving cavity 104 or the connection 104A thereof preferably in a permanent manner, i.e. it preferably cannot be released again. The connection 104A therefore preferably cannot be reopened after it has been closed.

In the example shown, the closure element 130 preferably comprises a base part 131 and a closure part 132, the closure part 132 being movably and/or pivotally connected to the base part 131 in particular by means of a connecting part 133 that is preferably formed bar-like in this case.

Particularly preferably, the base part 131 is fastened to the main body 101 in a form-fit or interlocking manner.

In the example shown, the base part 131 is preferably latched onto the cartridge 100, the main body 101 and/or the receiving cavity 104, or otherwise connected thereto in a form-fit, interlocking or bonded manner, for example by welding, heat staking, adhesion or the like.

Preferably, in the closed state, the closure element 130 or the closure part 132 thereof is sealingly held on or positioned against the connection 104A in a latching or form-fit or interlocking manner, in this case in particular by means of one or more latching or retaining arms or elements 134, as shown in FIG. 3. However, other structural solutions are also possible.

In the example shown, these retaining arms or elements 134 can encompass or extend over a peripheral edge or projection of the closure part 132 when the closure part 132 is sealingly placed on the connection 104A. However, other structural solutions are also possible.

Figure 5:
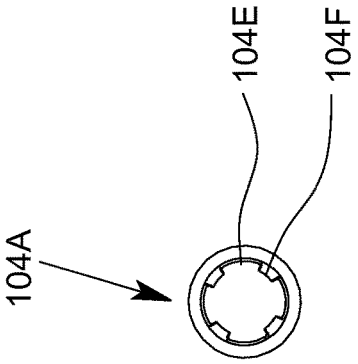
FIG. 5 is a schematic plan view of a connection of the receiving cavity.

FIG. 5 is a schematic plan view of the connection 104A of the receiving cavity 104. Preferably, the connection 104A, which is in particular substantially designed as a so-called Luer connection or Luer port or as a conical receiving opening, comprises an integrated vent 104E which is in particular formed by corresponding axial grooves in the inner wall of the connection 104 or by axially extending ridges or by inwardly protruding projections 104F, as shown in FIG. 5.

Figure 6:
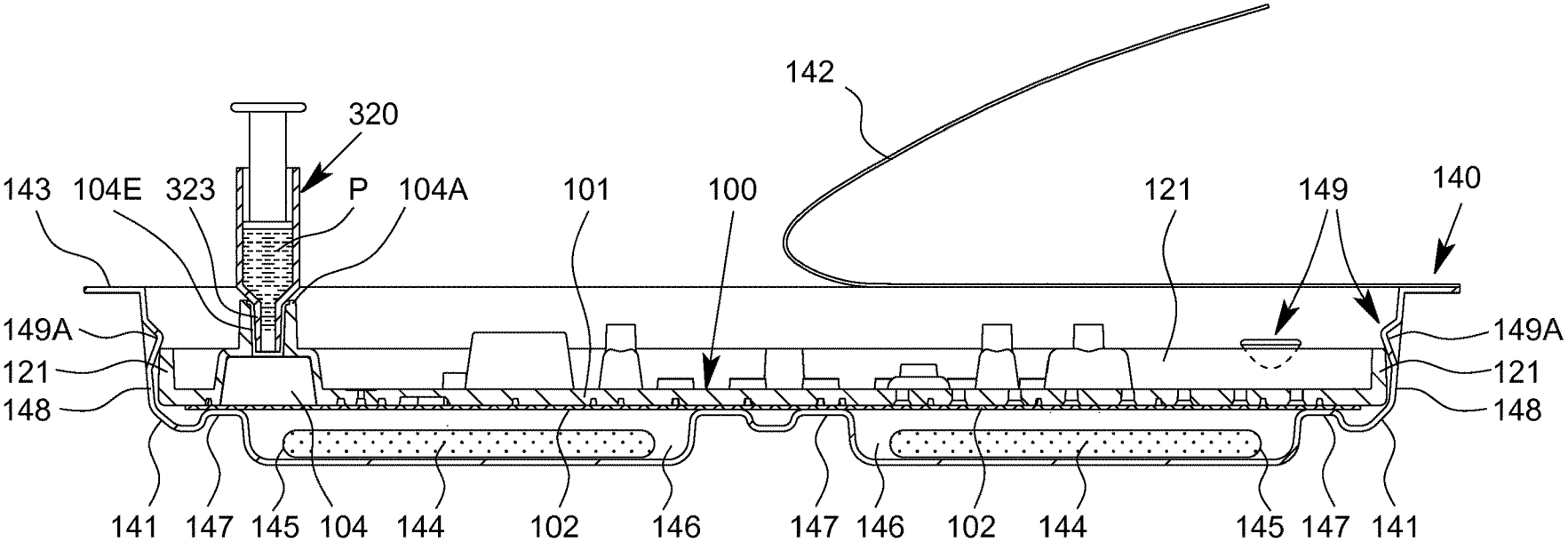
FIG. 6 is a schematic sectional detail of the cartridge while it is being filled with a sample.

FIG. 6 is a highly schematic sectional detail of the cartridge 100 or the receiving cavity 104 being filled, by means of a transfer apparatus 320, with the sample P to be tested. The transfer apparatus 320 is preferably formed in the manner of a syringe. However, other structural solutions are also possible.

The transfer apparatus 320 is preferably connected to and/or plugged into the connection 104A by means of a connection 323, in particular a connecting tip, particularly preferably in such a way that the vent 104E or the grooves formed thereby remain open so that, when the receiving cavity 104 is filled (in part) with the sample P, gas or air can escape from the receiving cavity 104 to the outside through the vent 104E. In this regard it is noted that, in the delivery state, the valves 115A assigned to the receiving cavity 104 are all closed, and the fluid system 103 is thus closed off from the receiving cavity 104 such that displaced air can escape only through the connection 104A and/or the vent 104E that is particularly preferably provided. However, other structural solutions are in principle also possible.

For reasons of simplicity, the closure element 130 is not shown in the sectional view according to FIG. 6.

FIG. 6 shows the cartridge 100 together with the connected transfer apparatus 320, but before the receiving cavity 104 is actually filled with the sample P or before said sample is actually fed to said cavity.

Figure 7:
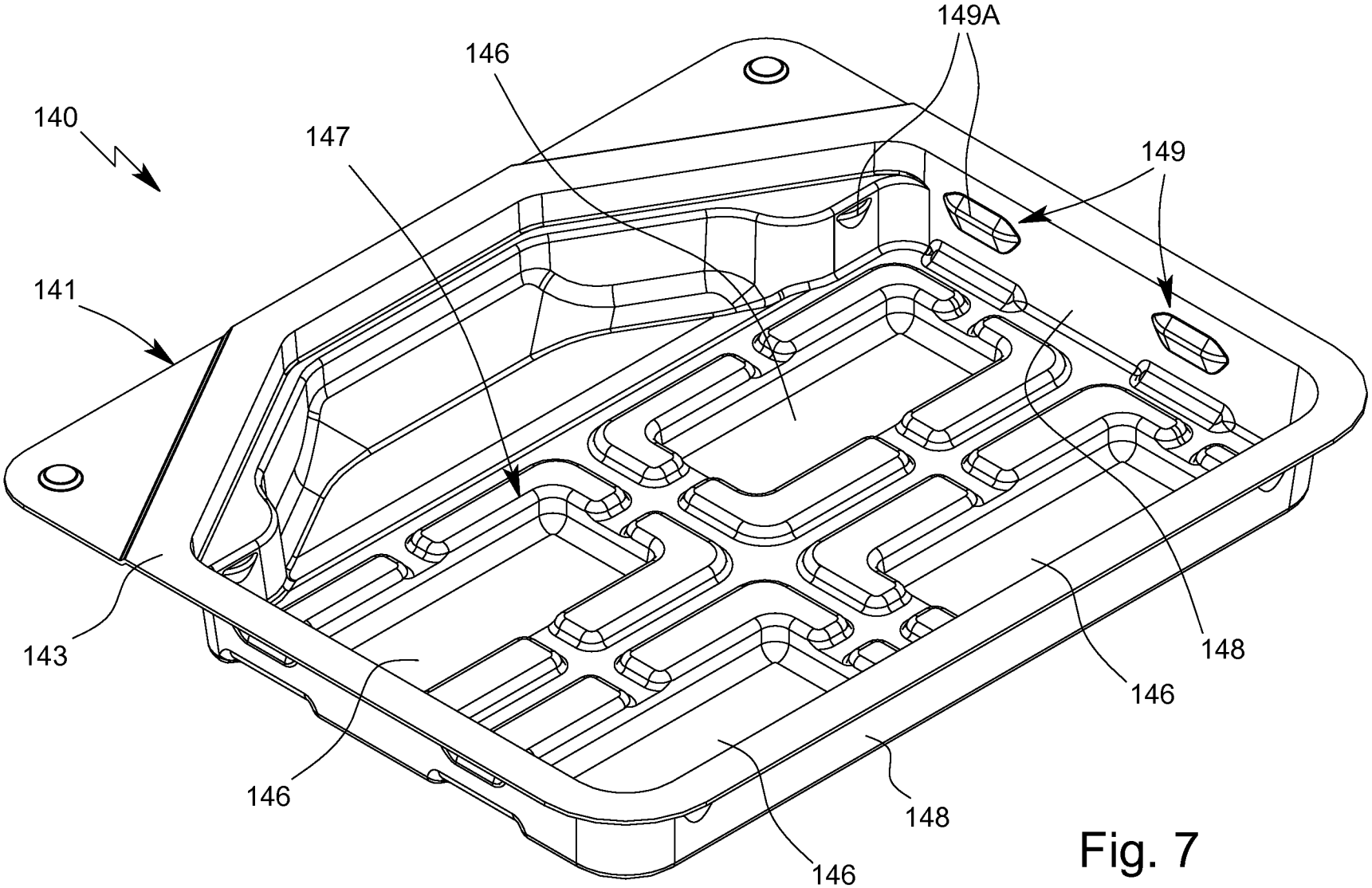
FIG. 7 is a schematic perspective view of a packaging of the cartridge.

A packaging 140 is shown by dashed lines in FIG. 6. In the following, a preferred construction of the packaging 140 is explained in more detail with reference to the schematic perspective view from FIG. 7.

The packaging 140 preferably comprises a lower part 141 and a lid 142. The lid 142 is not shown in FIG. 7, but rather just the opened lower part 141.

The packaging 140 is shown by dashed lines in FIG. 6, specifically in the open state, the lid 142 being shown pulled off or folded back in part.

Particularly preferably, the cartridge 100 is delivered in the closed packaging 140. The packaging encloses the cartridge 100 preferably in a liquid-tight manner and in particular in a gas-tight manner.

The packaging 140 and/or the lower part 141 is preferably designed as a blister.

Particularly preferably, the lower part 141 is designed as a plastics moulded part and/or is transparent in part.

The lid 142 is preferably formed by a film, in particular laminated onto the lower part 141, or the like.

The lid 142 is preferably fastened to a peripheral connection region 143, in particular on the upper face, of the lower part 141. However, other structural solutions are also possible.

The atmosphere in the packaging 140 is preferably conditioned, particularly preferably set to a desired relative humidity, for example of between 30 and 40%.

The packaging 140 preferably comprises a desiccant 144 that is particularly preferably received packaged in a bag 145, as shown schematically in FIG. 6.

Particularly preferably, the packaging 140 and/or the lower part 141 comprises at least one receiving compartment 146 for the desiccant 144 and/or the bag 145.

The desiccant 144 and/or the receiving compartment 146 is preferably arranged below the cartridge 100 and/or at the flat side of the cartridge 100 remote from the lid 142.

Preferably, the packaging 140 and/or the lower part 141 comprises a plurality of receiving compartments 146 that are separated from one another.

Preferably, the packaging 140 and/or the lower part 141 comprises a support apparatus 147 that is formed in particular in the base of the lower part 141 and/or by corresponding raised portions and/or reinforcements in order to support the cartridge 100 on its lower face and/or front 100A. Specifically, the smooth flat side and/or the front 100A and/or cover 102 of the cartridge 100 is preferably oriented downwards and/or towards the lower part 141 in the packaged state.

The packaging 140 and/or the lower part 141 preferably comprises a peripheral edge 148 for mounting and/or encompassing the cartridge 100, in particular laterally. The inner contour of the lower part 141 and/or the edge 148 is in particular adapted to the outer contour of the cartridge 100 in a plan view of the flat side.

The packaging 140 and/or the lower part 141 preferably comprises a mounting apparatus 149 for mounting the cartridge 100 in the lower part 141, in particular in a latching form-fit, interlocking and/or clamped manner, also when the lid 142 is removed and/or open.

The mounting apparatus 149 preferably comprises one or more projections 149A which are in particular formed by the edge 148 of the lower part 141 and/or protrude inwards and/or extend over the cartridge 100 and/or main body 101 and/or the edge 121 in the received state, as shown by way of example on the left-hand side of FIG. 6. Preferably, the cartridge 100 is in particular thus held in the packaging 140 and/or in the lower part 141 preferably in a form-fit, interlocking and/or latching manner, also when the lid 142 is removed and/or open.

The projections 149A particularly preferably form detents or locking pins. However, other structural solutions are also possible.

As already mentioned, the cartridge 100 is preferably delivered to the customer, for example a veterinary practitioner, packaged in the mentioned packaging 140. The cartridge 100 and the packaging 140 thus in particular form a sales unit. The cartridge 100 preferably comprises the packaging 140.

The packaging 140 is preferably opened by pulling off or folding open the lid 142.

The cartridge 100 and/or packaging 140 is preferably designed such that, when the packaging 140 is open, the cartridge 100 can be or is filled with the sample P while the cartridge 100 is (still) received in the packaging 140 and/or in the lower part 141.

In particular, the connection 104A is arranged on a flat side and/or on the side of the cartridge 100 that is oriented upwards and/or towards the lid 142 in the packaging 140.

In particular, the connection 104A of the cartridge 100 is open towards the lid 142.

When the lid 142 is removed and/or open, the connection 104A of the cartridge 100 can be accessed preferably directly or, if necessary, after an additional protective cap or cover or the like has been removed.

The packaging 140 and/or the lower part 141 holds or supports the cartridge 100, in particular by means of the support apparatus 147, the edge 148 and/or the mounting apparatus 149, in such a way that the cartridge 100 can be or is easily and reliably filled with the sample P in the opened packaging 140 and/or in the open lower part 141, as shown schematically in FIG. 6.

Particularly preferably, the cartridge 100 and/or the connection 104A is closed by means of the closure element 130 or the closure part 132 before the cartridge 100 is removed, i.e. when still in the packaging 140 and/or in the lower part 141, and the cartridge 100 is preferably removed from the packaging 140 and/or the lower part 141 only subsequently.

For removal of the cartridge 100, the edge 148 of the lower part 141 is preferably sufficiently flexible to be able to overcome the projections 149A by means of corresponding deformation.

Alternatively, however, the cartridge 100 can also be closed only after it has been removed from the packaging 140 and/or the lower part 141.

The packaging 140 and/or the lid 142 is preferably designed transparent in such a way and/or in part that, when the packaging 140 is in the closed state, the identifier and/or barcode 124, if provided, can be read.

Once the sample P has been introduced into the receiving cavity 104 and the connection 104A has been closed, the cartridge 100 can be inserted into and/or received in the proposed analysis device 200 in order to test the sample P, as shown in FIG. 1.

The analysis device 200 preferably comprises a mount or receptacle 201 for mounting and/or receiving the cartridge 100.

Preferably, the cartridge 100 is fluidically, in particular hydraulically, separated or isolated from the analysis device 200. In particular, the cartridge 100 forms a preferably independent and in particular closed or sealed fluidic or hydraulic system 103 for the sample P and the reagents and other liquids. In this way, the analysis device 200 does not come into direct contact with the sample P and can in particular be reused for another test without being disinfected and/or cleaned first.

It is however provided that the analysis device 200 is connected or coupled mechanically, electrically, thermally and/or pneumatically to the cartridge 100.

In particular, the analysis device 200 is designed to have a mechanical effect, in particular for actuating the pump apparatus 112 and/or the valves 115, and/or to have a thermal effect, in particular for temperature-controlling the reaction cavity/cavities 109 and/or the intermediate temperature-control cavity 110.

In addition, the analysis device 200 can preferably be pneumatically connected to the cartridge 100, in particular in order to actuate individual apparatuses, and/or can be electrically connected to the cartridge 100, in particular in order to collect and/or transmit measured values, for example from the sensor apparatus 113 and/or sensor portions 116.

The analysis device 200 preferably comprises a pump drive 202, the pump drive 202 in particular being designed for mechanically actuating the pump apparatus 112.

The analysis device 200 preferably comprises a connection apparatus 203 for in particular electrically and/or thermally connecting the cartridge 100 and/or the sensor arrangement or sensor apparatus 113.

As shown in FIG. 1, the connection apparatus 203 preferably comprises a plurality of electrical contact elements 203A, the cartridge 100, in particular the sensor arrangement or sensor apparatus 113, preferably being electrically connected or connectable to the analysis device 200 by the contact elements 203A.

The analysis device 200 preferably comprises one or more temperature-control apparatuses 204 for temperature-controlling the cartridge 100 and/or having a thermal effect on the cartridge 100, in particular for heating and/or cooling, the temperature-control apparatus(es) 204 (each) preferably comprising or being formed by a heating resistor or a Peltier element.

Preferably, individual temperature-control apparatuses 204, some of these apparatuses or all of these apparatuses can be positioned against the cartridge 100, the main body 101, the cover 102, the sensor arrangement, sensor apparatus 113 and/or individual cavities and/or can be thermally coupled thereto and/or can be integrated therein and/or can be operated or controlled in particular electrically by the analysis device 200. In the example shown, in particular the temperature-control apparatuses 204A, 204B and/or 204C are provided.

The analysis device 200 preferably comprises one or more actuators 205 for actuating the valves 115. Particularly preferably, different (types or groups of) actuators 205A and 205B are provided which are assigned to the different (types or groups of) valves 115A and 115B for actuating each of said valves, respectively.

The analysis device 200 preferably comprises one or more sensors 206. In particular, sensors 206A are assigned to the sensor portions 116 and/or are designed or intended to detect liquid fronts and/or flows of fluid in the fluid system 103.

Particularly preferably, the sensors 206A are designed to measure or detect, in particular in a contact-free manner, for example optically and/or capacitively, a liquid front, flow of fluid and/or the presence, the speed, the mass flow rate/volume flow rate, the temperature and/or another value of a fluid in a channel and/or a cavity, in particular in a respectively assigned sensor portion 116, which is in particular formed by a planar and/or widened channel portion of the fluid system 103.

Alternatively or additionally, the analysis device 200 preferably comprises (other or additional) sensors 206B for detecting the ambient temperature, internal temperature, atmospheric humidity, position, and/or alignment, for example by means of a GPS sensor, and/or the orientation and/or inclination of the analysis device 200 and/or the cartridge 100.

The analysis device 200 preferably comprises a control apparatus 207, in particular comprising an internal clock or time base for controlling the sequence of a test or assay and/or for collecting, evaluating and/or outputting or providing measured values in particular from the sensor apparatus 113, and/or from test results and/or other data or values.

The control apparatus 207 preferably controls or feedback controls the pump drive 202, the temperature-control apparatuses 204 and/or actuators 205, in particular taking into account or depending on the desired test and/or measured values from the sensor arrangement or sensor apparatus 113 and/or sensors 206.

Optionally, the analysis device 200 comprises an input apparatus 208, such as a keyboard, a touch screen or the like, and/or a display apparatus 209, such as a screen.

The analysis device 200 preferably comprises at least one interface 210, for example for controlling, for communicating and/or for outputting measured data or test results and/or for linking to other devices, such as a printer, an external power supply or the like. This may in particular be a wired or wireless interface 210.

The analysis device 200 preferably comprises a power supply 211 for providing electrical power, preferably a battery or an accumulator, which is in particular integrated and/or externally connected or connectable.

Preferably, an integrated accumulator is provided as a power supply 211 and is (re)charged by an external charging device (not shown) via a connection 211A and/or is interchangeable.

The analysis device 200 preferably comprises a housing 212, all the components and/or some or all of the apparatuses preferably being integrated in the housing 212. Particularly preferably, the cartridge 100 can be inserted or slid into the housing 212, and/or can be received by the analysis device 200, through an opening 213 which can in particular be closed, such as a slot or the like.

The analysis device 200 is preferably portable or mobile. Particularly preferably, the analysis device 200 weighs less than 25 kg or 20 kg, particularly preferably less than 15 kg or 10 kg, in particular less than 9 kg or 6 kg.

As already explained, the analysis device 200 can preferably be pneumatically linked to the cartridge 100, in particular to the sensor arrangement or sensor apparatus 113 and/or to the pump apparatus 112.

Particularly preferably, the analysis device 200 is designed to supply the cartridge 100, in particular the sensor arrangement or sensor apparatus 113 and/or the pump apparatus 112, with a working medium, in particular gas or air.

Preferably, the working medium can be compressed and/or pressurised in the analysis device 200 or by means of the analysis device 200.

Preferably, the analysis device 200 comprises a pressurised gas supply 214, in particular a pressure generator or compressor, preferably in order to compress, condense and/or pressurise the working medium.

The pressurised gas supply 214 is preferably integrated in the analysis device 200 or the housing 212 and/or can be controlled or feedback controlled by means of the control apparatus 207.

Preferably, the pressurised gas supply 214 is electrically operated or can be operated by electrical power. In particular, the pressurised gas supply 214 can be supplied with electrical power by means of the power supply 211.

Preferably, air can be drawn in, in particular from the surroundings, as the working medium by means of the analysis device 200 or pressurised gas supply 214. In particular, the analysis device 200 or pressurised gas supply 214 is designed to use the surroundings as a reservoir for the working medium or the air. However, other solutions are also possible here, in particular those in which the analysis device 200 or pressurised gas supply 214 comprises a preferably closed or delimited reservoir, such as a tank or container, comprising the working medium, and/or is connected or connectable thereto.

The analysis device 200 or pressurised gas supply 214 preferably comprises a connection element 214A, in particular in order to pneumatically connect the analysis device 200 or pressurised gas supply 214 to the cartridge 100.

In particular, the present invention relates also to any one of the following aspects which can be realized independently or in any combination, also in combination with any aspects described above or in the claims:

1. Cartridge 100 for testing an in particular biological sample P, the cartridge 100 comprising a receiving cavity 104 with a connection 104A for receiving the sample P and a closure element 130 for fluidically closing the connection 104A, characterized in that the cartridge 100 comprises a packaging 140, the packaging 140 comprising a support apparatus 147 for supporting the cartridge 100 and/or a mounting apparatus 149 for mounting the cartridge 100 in a form-fit, clamping and/or latching manner, and/or a lower part 141 comprising a peripheral edge 148 for receiving and mounting the cartridge 100, and a removable or pull-off lid 142 for closing the lower part 141, such that, when the packaging 140 is open, the cartridge 100 can be filled in the packaging 140 and the connection 104A can be closed in the packaging 140.
2. Method for testing an in particular biological sample (P) by means of a cartridge (100), the cartridge (100) comprising a receiving cavity (104) for receiving the sample (P), and a connection (104A) of the receiving cavity (104) being closed by means of a closure element (130) after the cartridge has been filled with the sample (P), characterized in that the cartridge (100) is filled with the sample (P) in the open packaging (140) and is removed from the packaging (140) only subsequently.

Individual aspects and features of the present invention and individual method steps and/or method variants may be implemented independently from one another, but also in any desired combination and/or order.

What is claimed is:

1. A cartridge for testing a sample, comprising:
- a cartridge body;
- a receiving cavity in the cartridge body, the receiving cavity having a connection for receiving the sample;
- a closure element associated with the cartridge body for fluidically closing the connection; and
- a packaging enclosing the cartridge body on all sides in a delivery state, wherein the packaging comprises:
- a lower part for receiving the cartridge, and
- a removable lid for closing the lower part in the delivery state the lid being removable for opening the packaging to provide access to the cartridge body, such that, when the packaging is open, the cartridge can be filled and the connection can be closed while in the lower part of the packaging, and at least one of:
- a support apparatus for supporting the cartridge body, or
- a mounting apparatus for mounting the cartridge body in at least one of a form-fit, interlocking, clamping and latching manner.

2. The cartridge according to claim 1, wherein the closure element can be at least one of plugged and latched onto the connection.

3. The cartridge according to claim 1, wherein the connection at least one of projects towards the lid and is open towards the lid in the non-closed state.

4. The cartridge according to claim 1, wherein the connection is arranged on a flat side or upper face of the cartridge and the cartridge is received with an opposite flat side or lower face in the lower part of the packaging.

5. The cartridge according to claim 1, wherein the lower part comprises the support apparatus.

6. The cartridge according to claim 1, wherein at least one of the packaging and the lower part is designed as a blister.

7. The cartridge according to claim 1, wherein the packaging contains a desiccant.

8. The cartridge according to claim 1, wherein at least one of the packaging and the lower part thereof comprises a receiving compartment for a desiccant.

9. The cartridge according to claim 8, wherein the receiving compartment is arranged between the support apparatus.

10. The cartridge according to claim 1, wherein the cartridge comprises an optically readable identifier and the packaging is transparent at least in part, such that the identifier can be read from the outside when the packaging is closed.

11. The cartridge according to claim 1, wherein the mounting apparatus comprises projections protruding inwards or at the edge.

12. The cartridge according to claim 1, wherein the cartridge is held in a latching, form-fit, interlocking manner in the lower part, when the lid is at least one of open and removed.

13. The cartridge according to claim 1, wherein the packaging contains a conditioned atmosphere.

14. The apparatus according to claim 1, wherein the cartridge is at least substantially flat and card-like and wherein the connection is arranged on a flat side of the cartridge that, in the packaging, is oriented at least one of upwards or towards the lid.

15. The apparatus according to claim 1, wherein the lower part comprises a peripheral edge for receiving and mounting the cartridge.

16. A method for testing a sample by means of a cartridge, comprising:

providing the cartridge in a packaging that encloses the cartridge on all sides;

opening a lid of the packaging;

receiving the sample in a receiving cavity of the cartridge after opening of the lid;

closing a connection of the receiving cavity by means of a closure element after the cartridge has been filled with the sample, and removing the cartridge from the packaging only subsequent to the cartridge being filled with the sample.

17. The method according to claim 16, wherein the connection of the receiving cavity is closed when still in the packaging and before the cartridge is removed, after the cartridge has been filled with the sample.

18. The method according to claim 16, wherein the packaging is provided with a support apparatus for supporting the cartridge during filling.

19. The method according to claim 16, wherein the packaging is provided with a mounting apparatus for mounting the cartridge in at least one of a form-fit, interlocking, clamping and latching manner.

20. The method according to claim 16, wherein the packaging is provided with a lower part comprising a peripheral edge for receiving and mounting the cartridge, and with a removable lid for closing the lower part.

21. The method according to claim 16, wherein the closure element is at least one of plugged and latched onto the connection.

22. The method according to claim 16, wherein the cartridge is at least substantially flat and card-shaped and wherein the connection is arranged on a flat side of the cartridge that is oriented upwards when filling the cartridge.

23. The method according to claim 16, wherein the cartridge is received in a lower part of the packaging such that the connection projects towards the lid in the delivery state.

* * * * *